US007513782B1

(12) United States Patent
Sheldon et al.

(10) Patent No.: US 7,513,782 B1
(45) Date of Patent: Apr. 7, 2009

(54) THREE PRONG PLUG WITH GROUND SAFETY CUTOUT

(75) Inventors: Bradley Sheldon, Kenosha, WI (US); Walter M. Sheldon, Lincolnshire, IL (US); Brad Davis, Mundelein, IL (US); Trevor Sheldon, Chicago, IL (US)

(73) Assignee: Sure Ground L.L.C. IL (US)

( * ) Notice: Subject to any disclaimer, the term of this patent is extended or adjusted under 35 U.S.C. 154(b) by 0 days.

(21) Appl. No.: 11/837,217

(22) Filed: Aug. 10, 2007

(51) Int. Cl.
*H01R 13/648* (2006.01)

(52) U.S. Cl. ..... 439/106

(58) Field of Classification Search ..... 439/103, 439/106, 104, 170, 171, 172; 200/51 R; 174/51; 632/222
See application file for complete search history.

(56) References Cited

U.S. PATENT DOCUMENTS

| | | | | |
|---|---|---|---|---|
| 1,605,904 | A | | 11/1926 | Van Brunt |
| 1,944,196 | A | | 1/1934 | Saraceno |
| 2,731,629 | A | * | 1/1956 | Siderman ..... 340/654 |
| 3,025,486 | A | | 3/1962 | Falconer |
| 3,308,415 | A | | 3/1967 | Cramer |
| 3,685,000 | A | * | 8/1972 | Robbins ..... 439/103 |
| 3,733,576 | A | * | 5/1973 | Cooper ..... 439/103 |
| 3,873,951 | A | * | 3/1975 | Blake ..... 335/164 |
| 3,890,030 | A | * | 6/1975 | McDaniel ..... 439/490 |
| 3,914,565 | A | | 10/1975 | Neidermeyer |
| 4,318,578 | A | * | 3/1982 | Ericson et al. ..... 439/106 |
| 5,207,594 | A | * | 5/1993 | Olson ..... 439/490 |
| 5,622,509 | A | | 4/1997 | Smythe |
| 5,772,447 | A | | 6/1998 | Cheung |
| 6,419,504 | B1 | | 7/2002 | Nelson |
| 6,910,911 | B2 | | 6/2005 | Mellot |

* cited by examiner

*Primary Examiner*—Alexander Gilman
(74) *Attorney, Agent, or Firm*—Patnaude and Videbeck

(57) ABSTRACT

A three-prong electrical plug includes a replaceable ground prong and circuitry inside the plug to preclude its functioning without the ground prong.

11 Claims, 3 Drawing Sheets

THREE PRONG PLUG WITH GROUND SAFETY CUTOUT

This invention relates to electric three-prong connectors, and more specifically, to a three-prong connector that will not transmit electricity if the ground prong is removed or damaged.

BACKGROUND OF THE INVENTION

The use of three-prong plug electrical connectors for appliances, extension cords, electric tools, etc. has become widespread. The use of three prongs, hot, neutral and ground, makes the operation of any electric appliance, tool, etc. safer. If there is a short, the ground wire provides a safe path for current.

The standards for a three-prong plug include, hot and common or neutral prongs that are elongate and flat (usually sheet metal, backfolded at the distal end of the prong). In contrast, the ground prong is cylindrical in shape, i.e., usually a piece of sheet metal bent to form a hollow cylindrical shape or "U" shape with a rounded distal end. In a typical three-prong plug, the hot and neutral prongs are somewhat ductile being flat and may be bent from side to side when being pulled from a socket and then manually straightened again. However, the hollow cylindrical or U shape ground prong has normally been heavily worked by being bent into its hollow shape and has become work hardened or brittle, even before it is put in use. Also, it is not ductile from side to side as are the hot and common prongs. Further, the ground prong being made from sheet stock, a tongue or unbent central portion that extends from the hollow cylinder into the plug housing becomes a weak point in the ground prong design, if it is repeatedly bent (as are the hot and common prongs) when being pulled from an electrical socket.

The differences in ductility and brittleness between the hot and neutral prongs and the ground prong, results in differences in their fracture rates on the same three prong plug. In use, the brittle stiff ground prong often severely bends or fractures at its base with the rubber insulation cover of the plug. If thus deformed, an operator may then break off the ground prong. The problem with conventional three-prong plugs is that the plug will continue to work as a two-prong plug, although it will not provide the safety of a ground connection in case of a short.

Many municipal codes require or mandate discarding or non-use of electrical plugs or extension cords lacking a useable ground prong. However, in use, especially at construction sites, workmen encountering a damaged ground prong on such a connector will break off the ground prong and use the connector in an ungrounded condition, in violation of such codes.

In an effort to overcome the deficiencies of a standard three-prong plug, U.S. Pat. No. 5,622,509 provides a three-prong electrical connector having a flexible resilient grounding prong. However, the spiral wound grounding prong may be too resilient for its application as disclosed in the patent.

U.S. Pat. No. 3,914,565 discloses a three-prong plug invented in the 1970's when three-prong sockets were new in use. The solid ground prong is biased in a non-working position and must be moved into the body to close a pair of switches to provide a usable plug. The device is more complex than necessary and the added components provide more chance for failure in use. This patent depends upon the ground prong bottoming out in the socket which is not possible in all socket designs.

Other patents, U.S. Pat. Nos. 3,308,415 and 6,419,504 disclose retractable ground prongs. U.S. Pat. No. 3,205,486 discloses an extendable socket-like prong in connection with standard prongs. U.S. Pat. No. 4,318,578 discloses an electrical connector with a ground fault connector. Other electrical connections are shown at U.S. Pat. Nos. 5,772,447; 6,910,911; 1,944,296, and 1,605,904.

A need has developed for a simple three-prong electrical connector (plug) that provides the added safety feature of not functioning when the ground prong is disabled. Additionally, a need has developed for a three-prong male connector or plug that has the provision of easy repairability or replacement of the ground prong should the same become disabled.

SUMMARY OF THE INVENTION

It is therefore an object of the present invention, generally stated, to provide a new and improved three-prong male electrical connection plug. Another object of the present invention is the provision of a three-prong male electrical connector plug that ceases to function if the ground prong should become disabled.

Further, the ground prong is designed to break away or dislocate from its socket, prior to the breaking point of the prong itself simultaneously rendering the plug usable in an unsafe condition.

A further object of the present invention is the provision of an easily replaceable ground prong in a three-prong male electrical connector.

The invention is directed to a three-prong grounded electrical connector for operatively engaging a three-conductor electrical cord. The connector comprises a body of electrically-insulated materials including a first electrically-conductive lead secured in the body and extending therefrom, a second electrically-conductive lead secured in the body and extending therefrom, and an electrically conductive grounding prong selectively releasably secured in the body and extending therefrom. A switch in the body is operatively connectable to a hot conductor of the three conductor cord. A spring between the grounding prong in its operative position and the switch maintain the switch in a closed position. The switch is biased in an open position when the prong is released from securement in the housing.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

DETAILED DESCRIPTION OF THE PREFERRED EMBODIMENT

Figure 1:
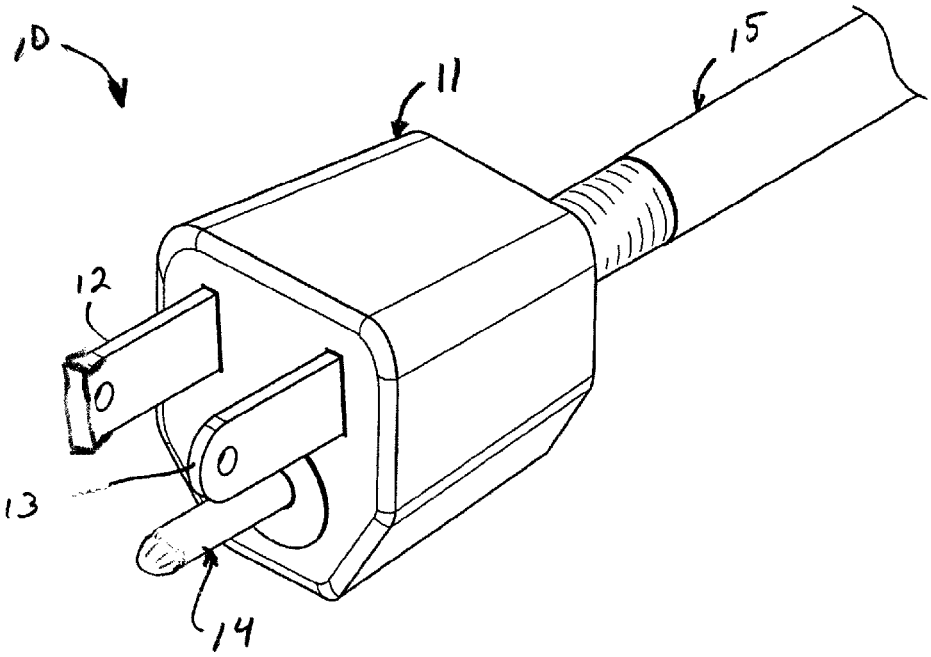
FIG. 1 is a three quarter top perspective view of a three-prong male electrical connection constructed in accordance with the present invention.

Referring to FIG. 1, a three-prong male electrical connector or plug, generally indicated at 10, and constructed in accordance with the present invention, includes an insulated housing, generally indicated at 11, preferably made of molded rubber, plastic or other non-conductive material, and further includes sticking outwardly therefrom on the distal end 16 thereof, a hot electrical prong 12, a neutral or common prong 13, and a ground prong 14. At the rear of the housing 11, a three wire electrical cord, generally indicated at 15, extends therefrom.

Figure 2:
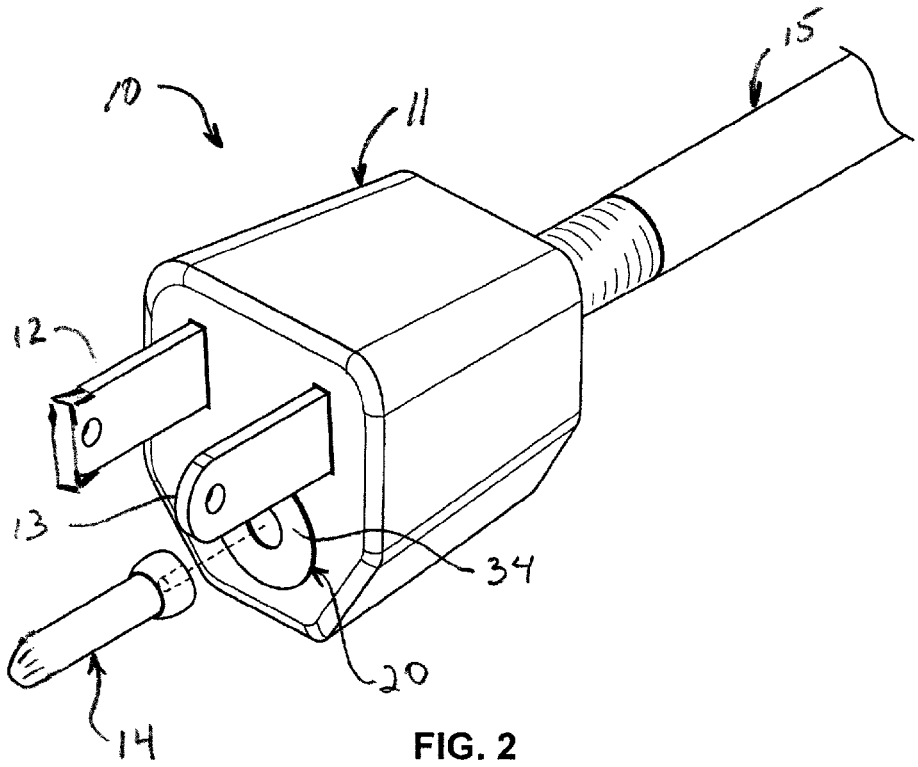
FIG. 2 is a three quarter top perspective view similar to that shown in FIG. 1 with the three-prong connection therein exploded outwardly.

Referring to FIG. 2, the ground prong 14 is shown exploded outwardly from its socket type receptacle, generally indicated at 20, to be described in more detail below. Ground prong 14 is selectably releasably retained in its socket receptacle 20 for two purposes. The first is so that it may be replaced if it becomes damaged, as often happens with electrical connectors or plugs. The second is that the rear of the ground prong 14 includes a spring 31 for biasing a contact or switch (26, 27) in the preferred embodiment, in the wiring of the hot prong 12, such that the entire plug will not conduct electricity if the ground prong is disabled.

Figure 3:
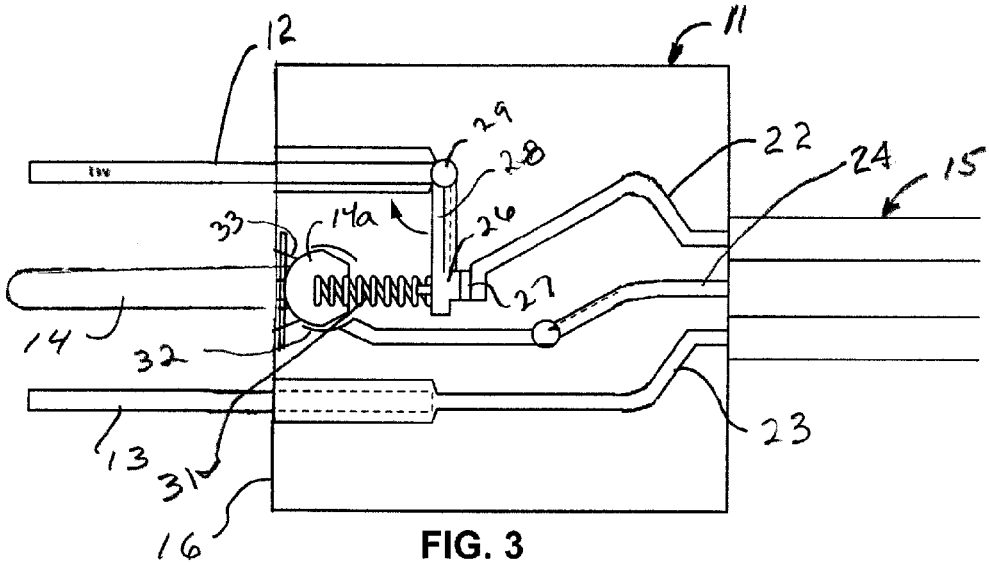
FIG. 3 is a top plan diagrammatic view of the connector shown in FIG. 1 showing the inner workings of the positive and ground prongs therein.
Figure 4:
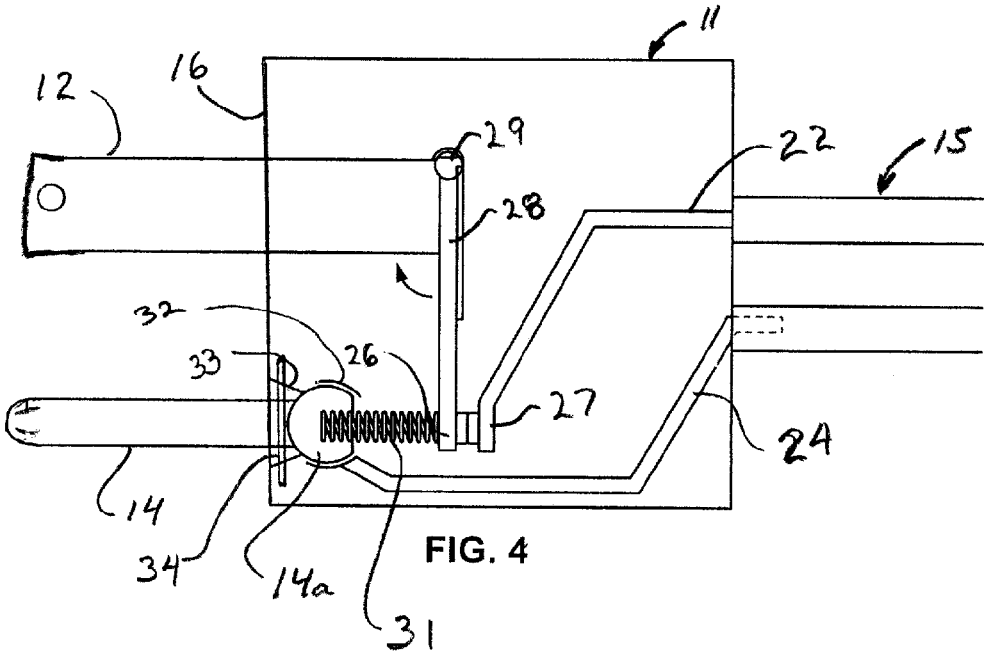
FIG. 4 is an elevational diagrammatic view of the three prong connector shown in FIG. 1 showing the inner workings of the three prongs therein.
Figure 5:
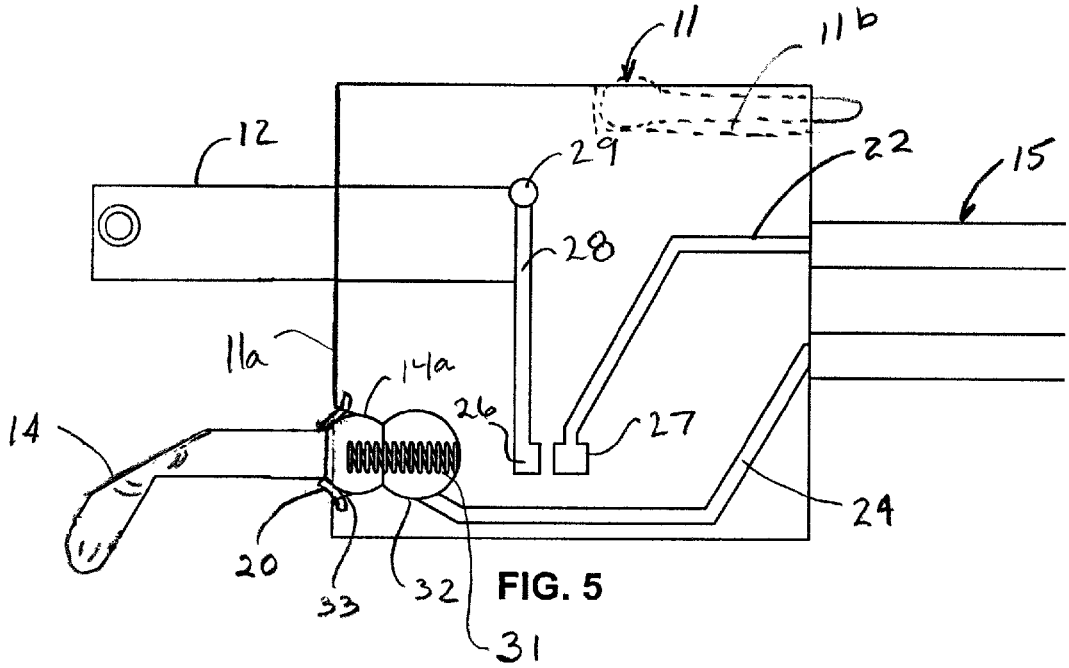
FIG. 5 is a side elevational diagrammatic view similar to FIG. 4 of the three-prong male connector of the present invention showing the disabling of the positive circuitry when the ground prong is damaged.

Referring to FIGS. 3, 4 and 5, diagrams of the internal parts of the male three-prong connector or plug 10 are shown. The inside of the housing 11 receives at its back end, the hot, common and ground conductors 22, 23 and 24, respectively, that extend from the three conductor cable 15. While hot prong 12 is fixedly embedded in the molded housing 11, a pair of electrical contacts, 26, 27 are retained on the ends of prong 12 and conductor 22, respectively, so as to provide current from the hot conductor 22 to the hot prong 12 when the contacts 26, 27 are closed. In this embodiment, contact 27 is stationary in the housing 11 while the other of the contacts 26 is mounted on an arm 28 connected at a bendable bight portion 29 to the interior end of positive prong 12. With the arm 28 biased in an open direction (shown by the arrow in FIGS. 3 and 4) the contacts 26 and 27 would tend to be open if not for a spring 31, made of insulative material or at least insulated from contact 26. While an internal end of spring 31 is in biased contact with the back end of contact 26, an outward end of spring 31 is received on the inner end of ground prong 14 where, if not made of insulative material, spring 31 is insulated from the remainder of ground prong 14. The spring may also be affixed at its end with contact 26 and be loosely insulatively received in a pocket at the ball end 14*a* of ground prong 14.

In one aspect of the present invention, the preferably solid ground prong 14, at its internal expanded or ball end 14*a* is received, in this preferred embodiment, in a ball shape socket 32 in housing 11 that is conductively connected to the ground lead 24. Outwardly adjacent the ball shape socket 32 is a conical hollow area, generally indicated at 33 which has an annular shaped resilient retaining ring 34 mounted thereacross. While the preferred embodiment is ball shaped at its inner end 14*a*, it will be understood that other shapes that provide a known resistance to their removal may be utilized within the scope of the invention. The inner end of ball shaped socket 32 where it joins conical area 33 is of a constricted diameter that retains the ball end 14*a* of prong 14 in its mounted position, up to a point. The size of the constriction may be varied to assure that a predetermined minimum force is necessary to remove the prong from the socket.

Referring to FIG. 5, the purpose of the resilient annular retaining ring 33 in the preferred embodiment is shown in more detail. When the ground prong 14 is dislodged from the connective conducting socket 32, either purposefully or by accident, it extends outwardly from the socket to the conical area 33 adjacent the front wall 11*a* of the housing 11.

The resilient annular retaining ring 33 deforms outwardly a sufficient amount to restrain the ball end 14*a* of ground prong 14 from fully exiting the front end of the plug housing 11. With the ground prong 14 pulled out of its socket 32, the spring 31 releases its bias against contact 26. The bias built in the bight portion 29 and arm 28 of contact 26 opens the contacts 26 and 27 stopping current flow from hot lead 22 into hot prong 12, thus rendering the connector temporarily inoperable. With the ground prong being solid, it is difficult for a user to cut the prong in two in an attempt to provide operability to the connector. Generally less force is necessary to pull the ground prong out through the retaining ring 34 than through the socket constricted area.

However, spare or replacement ground prongs 14 are available to replace the damaged ground prong and may be inserted through the resilient annular ring and conical section 33 into the socket 32 at which time the spring 31 positioned in the inner end of the ball portion 14*a* again biases contact 26 against contact 27 to provide a workable three prong plug.

When the ground prong 14 is deformed such that it cannot be inserted into a conventional three-prong socket, the connector of the invention will not operate as a two prong connector, if the ground prong 14 is pulled out of its socket. However, identical spare ground prongs may be utilized similarly to bits in a drill. They may be stored away from the connector or, if consistent with UL policies and CPSC rules, a spare prong may be stored by removably embedding same in a slot 11*b* in the top of the insulative housing 11. When the ball end 14*a* of the spare ground prong 14 is inserted in the socket 32, the connector will again function properly and safely.

While one embodiment of the present invention has been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed is:

1. A three-prong grounded electrical connector for operatively engaging a conductor electrical cord comprising:

a body of electrically-insulated material;

a first electrically-conductive lead secured in said body and extending therefrom, a second electrically-conductive lead secured in said body and extending therefrom, an electrically-conductive grounding prong selectively releasably secured in said body and extending therefrom, a switch in said body, said switch operatively connected between one of said first and second leads and to a hot conductor of said three conductor cord, and means between said grounding prong in its operative position and said switch for maintaining said switch in a closed position, said switch being biased in an open position when said prong is released from securement in said housing.

2. The three prong grounded electrical connector as defined in claim 1 further including, a ground prong passageway in said body, and means for selectably releasably securing said ground prong in said body include, diametrically enlarged means on one of said ground prong and said passageway and complementary diametrically constricted means on said other of said ground prong and said passageway.

3. The three prong grounded electrical connector as defined in claim 1 wherein, said ground prong is made of solid conductive material for preventing manual cutting through the middle of said prong.

4. A three prong grounded electrical connector comprising:

a body of electrically insulated material, a first electrically conductive lead secured in said body and extending therefrom, said first lead dimensioned and configured to operationally engage a hot conductor of a three conductor electrical cord, an electrically conductive grounding prong secured in a socket in said body and extending therefrom, said grounding prong dimensioned and configured to operationally engage a ground conductor of the three-conductor cord, and a switch operatively connected to said first conductor lead that engages said hot conductor when said grounding prong is in said socket, an absence of said electrically-conductive prong seating in said socket biasing said switch in an open position preventing operation of said connector.

5. The three prong connector as defined in claim 4 wherein said means for biasing said switch includes said socket retaining said prong in operable engagement in said housing up to a predetermined pulling force, and spring means adjacent an inner end of said prong extending to said switch for biasing same in a closed position when said prong is seated in said socket.

6. The three prong connector as defined in claim 5 wherein said socket includes, a diametrically enlarged inner end on said prong, and a prong mounting passageway in said housing, said passageway including a diametrically constricted portion smaller than said diametrically enlarged portion of said prong.

7. A three prong grounded electrical connector comprising:

a body of electrically-insulated material;

a first electrically conductive lead secured in said body and extending therefrom, said first lead dimensioned and configured to operationally engage a hot conductor of a three-conductor electrical cord, a second electrically-conductive lead secured in said body and extending therefrom, said second lead dimensioned and configured to operationally engage a neutral conductor of the three-conductor cord; and an electrically-conductive grounding prong substantially fixedly mounted in said body and extending therefrom, said grounding prong dimensioned and configured to operationally engage a ground conductor of the three-conductor cord, said grounding prong being generally cylindrical in shape and including a radially enlarged inward distal end, said body including a generally cylindrical hollow passageway with a constricted portion for substantially fixedly retaining said grounding prong therein, said body including a switch therein operatively connected to said first electrical lead and a hot conductor of said three-conductor cord, the mounting of said grounding prong in said hollow passageway closing said switch and any movement of said grounding prong outwardly of its mounted position opening said switch to prevent use of the three-prong connector.

8. A three prong grounded electrical connector with a ground interrupter circuit, said connector comprising:

an electrically insulative housing;

a positive lead and a negative lead fixedly mounted on said housing;

a ground prong substantially fixedly mounted on said housing;

a three conductor cord mounted on said housing with one of said conductors operatively connected respectively to said positive lead, said negative lead and said ground prong, and any movement of said ground prong from its substantially fixed mounting opening said operative connection between one of said positive and negative leads and said one of said respective conductors.

9. The three prong connector as defined in claim 8 wherein, any movement of said ground prong from said substantially fixed mounting on said housing opens said operative connection between said ground prong and said respective connector.

10. The three prong connector as defined in claim 8 further including, a switch between one of said positive lead and its respective conductor and said negative lead and its respective connector, said switch being biased by said ground prong with closed position.

11. The three prong connector as defined in claim 8 wherein, said ground prong is replaceable.

* * * * *